United States Patent [19]

Weyn

[11] 3,935,999

[45] Feb. 3, 1976

[54] SPRAY CONFINING AEROSOL DEVICE

[75] Inventor: Hendrik Frans Weyn, Le Chesnay, France

[73] Assignee: Colgate-Palmolive Company, New York, N.Y.

[22] Filed: Nov. 18, 1974

[21] Appl. No.: 524,510

[30] Foreign Application Priority Data

Dec. 19, 1973 France ..... 73.45487

[52] U.S. Cl. ..... 239/288.5; 222/182; 222/402.13

[51] Int. Cl.[2] ..... B05B 1/28; B05B 15/04

[58] Field of Search ..... 239/288, 288.3, 288.5; 222/182, 402.13

[56] References Cited

UNITED STATES PATENTS

| | | | |
|---|---|---|---|
| 3,012,555 | 12/1961 | Meshberg | 222/402.13 X |
| 3,254,803 | 6/1966 | Meshberg | 222/182 |
| 3,306,252 | 2/1967 | Knight et al. | 222/182 X |
| 3,450,299 | 6/1969 | Barbera | 222/182 X |
| 3,738,537 | 6/1973 | Gach | 222/402.13 X |
| 3,756,514 | 9/1973 | Brown | 239/288.5 X |
| 3,814,297 | 6/1974 | Warren | 222/402.13 |
| 3,841,533 | 10/1974 | Carroll et al. | 222/402.13 |

*Primary Examiner*—Robert S. Ward, Jr.
*Attorney, Agent, or Firm*—Herbert S. Sylvester; Murray M. Grill; Norman Blumenkopf

[57] ABSTRACT

A spray confining aerosol dispensing device, includes a pressurized aerosol container provided with an upwardly directed axial nozzle on its top wall and a valve actuator including a pair of depressible opposite radial arms extending beyond the container periphery. A shield sleeve slidably engages the container and is horizontally rotatable and vertically movable between upper and lower positions. A pair of peripherally spaced ribs are formed on the sleeve inside face and are above the actuator arm level when the sleeve is extended, so that the sleeve may be rotated to bring the ribs in vertical registry with the actuator arms. Depression of the sleeve when pressed against a surface to be sprayed, opens the spray valve and the spray is confined by the sleeve. Stop members are provided on the sleeve to limit its axial movement on the container.

7 Claims, 6 Drawing Figures

10
11
12
13
14
16
17
18
19
20
21
22
22a
23
24
26
27
28
29
32
33
34
36
37
38
39
40
41

SPRAY CONFINING AEROSOL DEVICE

The present invention relates generally to improvements in spray devices and more particularly to an improved spray confining aerosol dispenser.

A widely used method of applying a material to a surface is by spraying the material, carried in a volatile carrier, onto the surface. A convenient device for producing such a spray is a pressurized aerosol container provided with a finger actuated, valved spray nozzle and loaded with a highly volatile propellant such as, for example, the fluorinated hydrocarbons, an example being the Freons. While the employment of a pressurized aerosol container for the application of an active material to a surface is highly convenient and possesses many advantages, when the spray is applied to the person, as where the spray contains an antiperspirant or deodorant for application to the axilla or arm pit, considerable overspray may be effected with the spray being incident on surfaces removed from the axilla, and some of the spray may be dispersed into the ambient atmosphere thereby resulting in wastage of product. In fact, as where light powder sprays are used, a proportion of the efficacy of the product may be lost due to "bounce-off".

It is a principal object of the present invention to provide an improved spray device having a spray confining shield axially collapsible upon the device.

Another object of the present invention is to provide an improved aerosol spray device employing a pressurized aerosol container.

Still another object of the present invention is to provide an improved aerosol container spray device in which the spray is confined to a predetermined region.

A further object of the present invention is to provide an aerosol spray device of the above nature, characterized by its reliability, simplicity, ruggedness, low cost, convenience and great versatility and adaptability.

The above and other objects of the present invention will become apparent from a reading of the following description taken in conjunction with the accompanying drawings which illustrate preferred embodiments thereof.

The present invention contemplates the provision of a spray confining aerosol spray device comprising a pressurized aerosol container, including a top wall on which is located a valve having an upwardly, axially directed spray nozzle having an outward extending valve actuator, a shield defining sleeve coaxial with and slidably engaging the container and provided on its lower inside face with a depressor member which may be positioned above and in vertical registry with the valve actuator, so that vertical downward pressure on the sleeve, or conversely upward pressure on the container, depresses the valve actuator to open the valve, whereby a spray is coaxially discharged from the nozzle and is confined by the sleeve.

According to a preferred form of the improved device as applied to an aerosol container provided with a main cylindrical wall having annular beads along its top and bottom edges, the valve actuator includes a pair of opposite radial arms projecting outwardly beyond the top bead. An inwardly directed peripheral bottom rib is formed on the bottom inside face of the sleeve and is movable with the raising and lowering of the sleeve into engagement with the top and bottom beads respectively, thereby limiting the axial movement of the sleeve. Extending upwardly from the bottom rib are a pair of short opposite ribs which extend peripherally about 90°, and located shortly above and peripherally and radially coextensive with the lower ribs are a pair of main ribs which extend to a point short of the upper edge of the sleeve. Another pair of relatively low ribs are located above and are radially and peripherally coextensive with the main ribs. The confronting end faces of the lower, main and top ribs delineate top and bottom 90° peripheral passages which alternatively engage the valve actuator arms to permit their depression or their locking in a raised position.

An alternate form of the improved spray device as applied to an aerosol container which is provided at its top with a converging curved shoulder instead of a peripheral bead, includes an axially slidable sleeve provided along its bottom inside face with a rib which slidably and rotatably engages the container cylindrical wall. A pair of 90° spaced 90° peripheral ribs are formed on the lower inside face of the sleeve shortly above the valve actuator arms when the sleeve is in its extended position, and a pair of opposite stop members project inwardly from the upper border of the sleeve and engage the container's curved upper shoulder when the sleeve is in its contracted position to restrict any further depression of the sleeve.

The improved spray devices are simple and inexpensive, are easy and convenient to use and confine the aerosol spray to the desired area of application.

Figures 1, 2, 3, 4, 5, 6:
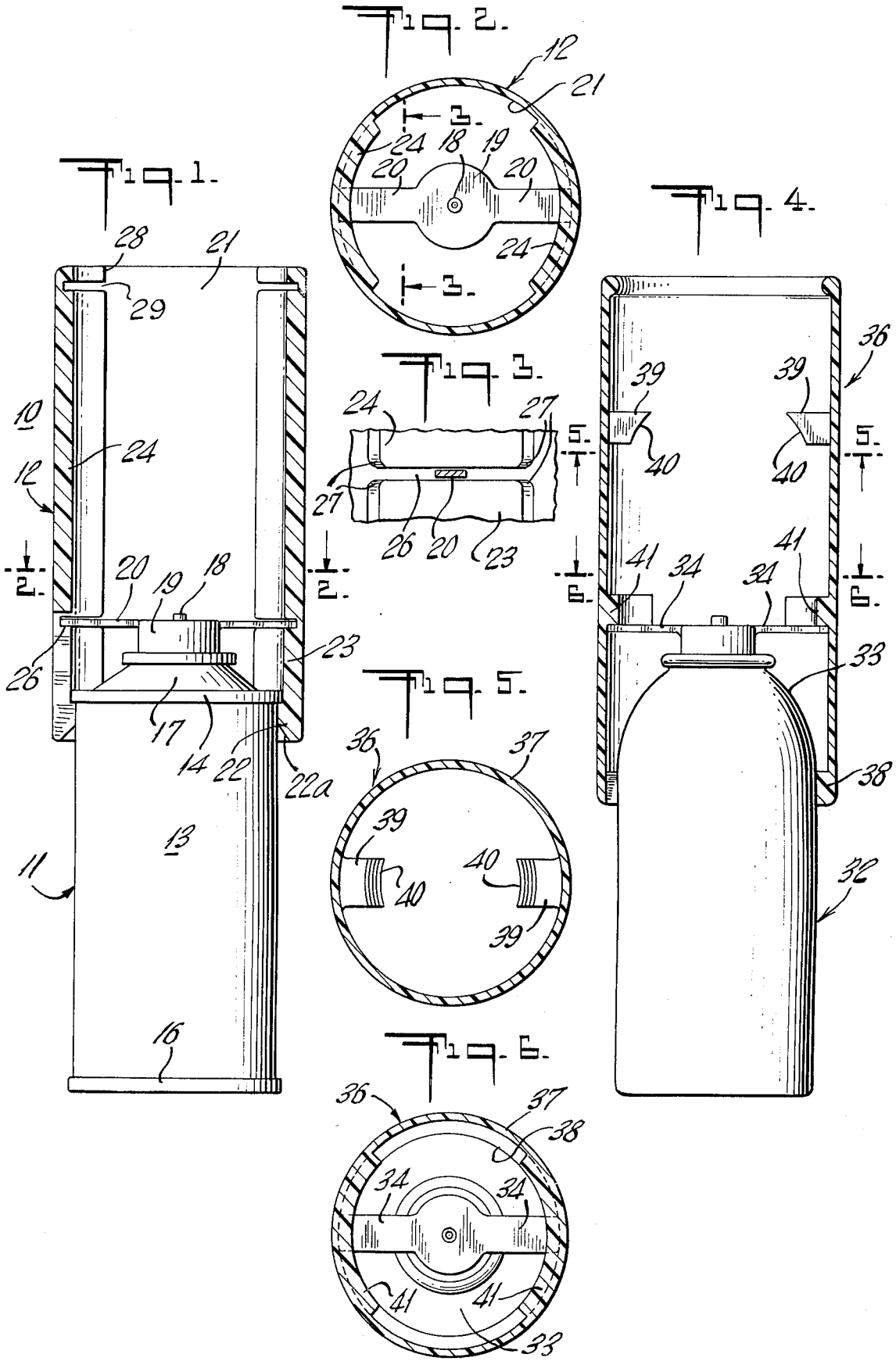
FIG. 1 is a front elevational view, partially in vertical medial section, of a preferred embodiment of the present invention.
FIG. 2 is a sectional view taken along line 2—2 in FIG. 1.
FIG. 3 is a sectional view taken along line 3—3 in FIG. 2.
FIG. 4 is a view similar to FIG. 1 of another embodiment of the present invention.
FIG. 5 is a sectional view taken along line 5—5 in FIG. 4.
FIG. 6 is a sectional view taken along line 6—6 in FIG. 4.

Referring now to the drawings, particularly FIGS. 1 to 3 thereof which illustrate a preferred embodiment of the present invention, the reference numeral 10 generally designates the improved aerosol spray device which includes a pressurized aerosol spray container 11 and a valve actuator depressor and spray confining shield sleeve 12. The aerosol container 11 is of conventional construction and includes a main cylindrical wall 13 provided at its top and bottom edges with overhanging peripheral top and bottom beads 14 and 16 respectively.

The container 11 is provided with a domed top wall 17 on which is located a coaxial, upwardly directed spray nozzle 18 which communicates with the bottom of container 11 through a dip tube and a normally closed valve (not shown) which is opened by the depression of a valve actuator 19 provided with a pair of opposite radial arms 20 which project outwardly a short distance beyond the peripheral bead 14. The container 11 is loaded with a volatile propellant such as a Freon having uniformly admixed therewith any desirable composition, for example, an antiperspirant or deodorant.

The sleeve member 12 is integrally formed as a unit of any suitable material, such as a synthetic organic polymeric resin, for example, polyethylene, polypropylene, polyvinyl chloride or the like, and includes a thin cylindrical outer wall 21 having an inside diameter greater than the outside diameter of peripheral bead 14. Projecting inwardly along the lower border of sleeve wall 21, and in sliding engagement with container wall 13, is an integrally formed peripheral rib or collar 22 having an annular upper shoulder which engages the upper face of bead 14 when sleeve 12 is in its raised extended position and an annular bottom shoulder which engages the top face of bottom bead 16 when the sleeve 12 is in its lowered contracted position. The collar 22 and the corresponding lower border of wall 21 are advantageously provided with peripherally spaced vertical slits (not shown) and chambered inner edge 21a to facilitate the assembly of the container 11 and sleeve member 12.

Extending above the collar 22 and projecting inwardly from wall 21 are a pair of diametrically opposite ribs or projections 23 each of which extends peripherally for about 90° and whose adjacent ends are spaced about 90°. The distance between the top faces of ribs 23 and collar 22 is about equal to the distance between the underfaces of actuator arms 20 and upper bead 14 and the inside diameter of ribs 23 is slightly larger than the outside diameter of bead 14.

A pair of diametrically opposed 90° peripherally extending ribs 24 are located above ribs 23 and are peripherally and radially coextensive therewith and extend to points a short distance below the top edge of wall 21. The confronting end faces of registering ribs 23 and 24 delineate peripheral tracks or passageways 26 and the corners of these faces are rounded, as at 27, to provide converging guide faces into the passageways 26. Formed at the top border of wall 21 are a pair of inwardly projecting low ribs 28 peripherally and radially coextensive with ribs 24 and delineating therewith passageways 29 similar to passageways 26 with converging end openings. The vertical distance between passageways 26 and 29 is about equal to the distance between the confronting faces of beads 14 and 16 less the height of collar 22. It should be noted, that while the upper edge of sleeve member 12 is illustrated as being planar, it may be undulate to mate the corresponding contour of the axilla.

In employing the spray device 10, the device 10 is held by holding the container 11 to position the upper edge of sleeve member 12, which is in its extended position as shown in FIG. 1, against the axilla. The container is then raised with sufficient pressure to depress the actuator arms 20 and open the spray valve. An aerosol spray is thus axially emitted from the nozzle 18 and is confined by the shield sleeve 12 to impinge in the area delineated by the upper edge of the sleeve 12 and to thereby eliminate or minimize any overspray.

In storing the device 10 it is contracted by twisting the sleeve 12 relative to the container 11 until the arms 20 are out of engagement with passageways 26 and the sleeve 12 is then depressed to its contracted position with the collar 22 abutting the bottom bead 16. The sleeve 12 may then be turned to bring the arms 20 into engagement with passageways 29 and thereby lock the actuator arms 20 against depression. The device 10 may be extended for use in the above manner by reversing the contraction procedure.

In FIGS. 5 to 7 of the drawings there is illustrated another embodiment of the present invention which employs an aerosol container 32 differing from container 11 in that it lacks the top and bottom beads, the top peripheral wall of the container being inwardly curved to provide a converging, convex annular shoulder 33. As in the first embodiment, the aerosol container is provided with an upwardly directed spray nozzle and a pair of opposite radial depressible valve actuator arms 34 which project beyond the container peripheral wall.

Associated with the container 32 is a relatively slidable and rotatable actuating, depressing, and spray confining sleeve 36 which includes a cylindrical wall 37 of somewhat greater inside diameter than the outside diameter of the container 32. Formed on the inside lower border of wall 37 is an oppositely split collar 38 which slidably and rotatably resiliently engages the cylindrical wall of container 32 to releasably, lightly, and frictionally maintain the sleeve 36 in a preset position. A pair of opposite stop members 39 are located on and project inwardly from the upper border of sleeve wall 37, the inner underface 40 of each stop member 39 being downwardly outwardly inclined to substantially mate the contour of the upper border of container shoulder 33.

The vertical distance between stop members 39 and collar 38 is somewhat less than the height of container 32, so that in the contracted condition of sleeve 36 with the stop members 39 engaging shoulder 33 the collar 38 is not completely below the bottom of container 32.

Integrally formed on the inside face of wall 37 above the collar 38 are a pair of inwardly directed opposite ribs 41, each of the ribs extending peripherally about 90° and having their proximate ends spaced about 90°. The inside diameter of ribs 41 is about equal to or slightly greater than the outside diameter of the container cylindrical wall and somewhat less than the distance between the outer ends of actuator arms 34. The spacing between collar 38 and ribs 41 is such that when collar 38 engages the upper cylindrical section of the container wall, as shown in FIG. 5, the ribs 41 are immediately above the level of actuator arms 34. It is contemplated however, that in some embodiments it may, for greater stability, be desirable to space ribs 41 and 38 at a greater distance and to provide an additional set of ribs at the upper cylindrical section of the container wall. It should be noted that diametrically opposite longitudinal slots of widths greater than that of actuator arms 34 are formed in collar 38 to facilitate the assembly of sleeve 36 with container 32.

The application and operation of the device last described is clear from the above and are similar to those of the device 10.

While there have been described and illustrated preferred embodiments of the present invention, it is apparent that numerous alterations, omissions and additions may be made without departing from the spirit thereof.

What is claimed is:

1. An aerosol spray device comprising a pressurized aerosol container including an axially directed spray nozzle and a transverse, outwardly directed, depressible valve actuator; a shield defining sleeve coaxial with and slidably engaging said container and movable between a raised extended position projecting above said container and a lower, contracted position telescoped onto said container; and actuator depressor means located on and movable with said sleeve and adapted to engage said valve actuator whereby to urge said actuator to a depressed, valve open position upon the depression of said sleeve below its extended position, said valve actuator including an arm projecting radially beyond the periphery of said container, and said actuator means includes an inwardly directed shoulder member positioned on the lower inner border of said sleeve and projecting to a point between the outer periphery of said container and the outer end of said actuator arm, said shoulder member extending for less than the full periphery of said sleeve.

2. The device of claim 1 wherein said sleeve is rotatable relative to said container and said actuator depressor means is rotatable with said sleeve into and out of engageable registry with said actuator.

3. An aerosol spray device comprising a pressurized aerosol container including an axially directed spray nozzle and a transverse, outwardly directed, depressible valve actuator; a shield defining sleeve coaxial with and slidably engaging said container and movable between a raised position projecting above said container and a lower, contracted position telescoped onto said container; and actuator depressor means located on and movable with said sleeve and adapted to engage said valve actuator whereby to urge said actuator to a depressed, valve open position upon the depression of said sleeve below its extended position, said container including a main peripheral wall provided with outwardly projecting annular beads along the top and bottom edges thereof and said sleeve including an inwardly projecting peripherally extending lip along its lower border movable into engagement with said top and bottom beads with the raising and lowering of said sleeve respectively.

4. An aerosol spray device comprising a pressurized aerosol container including an axially directed spray nozzle and a transverse, outwardly directed, depressible valve actuator; a shield defining sleeve coaxial with and slidably engaging said container and movable between a raised extended position projecting above said container and a lower, contracted position telescoped onto said container; and actuator depressor means located on and movable with said sleeve and adapted to engage said valve actuator whereby to urge said actuator to a depressed, valve open position upon the depression of said sleeve below its extended position, said valve actuator including a pair of opposite radial arms projecting beyond the peripheral edge of said container, said sleeve having an inside diameter of greater diameter than that of said container, and said depressor means comprises a pair of peripherally spaced, peripherally extending opposite ribs formed on the inside face of said sleeve along its lower border and having downwardly facing shoulders shortly above the level of said actuator arms, when said sleeve is in its extended position.

5. The device of claim 4 wherein said ribs extend upwardly to a point short of the upper edge of said sleeve and comprising a pair of opposite top ribs formed on the inside upper face of said sleeve spaced above and peripherally coextensive with said depressor ribs.

6. The device of claim 4 including a peripherally extending lower rib formed on the inside face of said sleeve and delineating with said depressor ribs opposite, peripherally extending passageways for slidably engaging said actuator arms.

7. The device of claim 4 including an inwardly directed stop member formed on the upper inside face of said sleeve.

* * * * *